US012638194B2

(12) United States Patent
Zhang et al.

(10) Patent No.: US 12,638,194 B2
(45) Date of Patent: May 26, 2026

(54) ISOLATION DEVICE FOR INSOLATING AEROSOL EXPOSURE

(71) Applicant: Medical Support Technology Research Department, Systems Engineering Institute, Academy of Military, Tianjin (CN)

(72) Inventors: Zongxing Zhang, Tianjin (CN); Jiancheng Qi, Tianjin (CN); Jinhui Wu, Tianjin (CN); Enlei Zhang, Tianjin (CN); Jinming Zhang, Tianjin (CN); Ying Yi, Tianjin (CN)

(73) Assignee: Medical Support Technology Research Department, Systems Engineering Institute, Academy of Military Sciences, Tianjin (CN)

( * ) Notice: Subject to any disclaimer, the term of this patent is extended or adjusted under 35 U.S.C. 154(b) by 438 days.

(21) Appl. No.: 18/196,363

(22) Filed: May 11, 2023

(65) Prior Publication Data

US 2023/0366569 A1 Nov. 16, 2023

(30) Foreign Application Priority Data

May 11, 2022 (CN) ..... 202210513299.5

(51) Int. Cl.
*F24F 3/167* (2021.01)

(52) U.S. Cl.
CPC ..... *F24F 3/167* (2021.01)

(58) Field of Classification Search
CPC ..... F24F 3/167
USPC ..... 454/187
See application file for complete search history.

(56) References Cited

U.S. PATENT DOCUMENTS 3,051,164 A * 8/1962 Trexler ..... A61G 10/005 312/1
3,850,172 A * 11/1974 Cazalis ..... A61B 90/40 600/21
5,257,957 A * 11/1993 Diccianni ..... B08B 15/02 454/56
7,323,025 B2 * 1/2008 Weidner ..... A61G 10/005 55/385.2
8,337,751 B2 * 12/2012 Stewart ..... A47K 3/286 52/79.5
9,086,225 B2 * 7/2015 Tanimoto ..... B25J 21/02
(Continued)

*Primary Examiner* — Avinash A Savani
*Assistant Examiner* — Dana K Tighe
(74) *Attorney, Agent, or Firm* — Suiter Swantz IP

(57) ABSTRACT

This disclosure discloses an isolation device for insolating aerosol exposure, which may be used as an isolation device for a test with a biological aerosol exposure infection risk. The isolation device for insolating aerosol exposure of the present disclosure includes a cabin body; protective half suit arranged in the cabin body; a working table arranged at an accessible horizontal position of the protective half suit in the cabin body; and an air inlet device and an air exhaust device arranged on a side wall of the cabin body. By using the support structure of the cabin body and the rigid frame, flexible assembling and disassembling of the isolation device and easiness in transportation are realized; and based on design mechanisms of negative pressure control, airtight isolation and high-level personnel protection, physical isolation of high-risk operations is realized, operation personnel is effectively protected, and environmental pollution is prevented.

12 Claims, 4 Drawing Sheets

(56) References Cited

U.S. PATENT DOCUMENTS

| | | | | |
|---|---|---|---|---|
| 11,698,199 | B2 * | 7/2023 | Kawasaki | B01L 1/04 454/187 |
| 2022/0387829 | A1 * | 12/2022 | Mattila | A62B 18/006 |

* cited by examiner

ISOLATION DEVICE FOR INSOLATING AEROSOL EXPOSURE

CROSS-REFERENCE TO RELATED APPLICATION

This patent application claims the benefit and priority of Chinese Patent Application No. 2022105132995 filed with the China National Intellectual Property Administration on May 11, 2022, the disclosure of which is incorporated by reference herein in its entirety as part of the present application.

TECHNICAL FIELD

The present disclosure relates to the technical field of isolation protection devices, and in particular, to an isolation device for insolating aerosol exposure.

BACKGROUND

Aerosol refers to a gaseous dispersion system composed of solid or liquid particles suspended in a gaseous medium. The density of the solid or liquid particles may be slightly or significantly different from the density of the gaseous medium. Bio-aerosol refers to the aerosol containing biological particles including bacteria, viruses, allergenic pollen, mycotic spores, fern spores, parasitic ova, and the like. In addition to the characteristics of general aerosol, the bio-aerosol also has infectivity, sensitization, and the like.

In a process of carrying out a life science research, in order to develop a vaccine drug for the prevention and treatment of infectious diseases, a pathogenic microorganism related test, such as an animal infection test, needs to be carried out. Bio-aerosol exposure infection equipment is a scientific device specially configured for carrying out an aerosol infection test on a small animal. However, in a process of the test, there is an aerosol leakage risk. Due to harmful effects of the aerosols on human bodies and an environment, the aerosols need be prevented from leaking into an external environment of the equipment as much as possible. In addition, since the existing bio-aerosol exposure infection equipment has a large size and heavy weight, a relatively large sealing door needs to be arranged on an isolation device and placed at a bottom of the isolation device, an operation panel is arranged on a side surface of the isolation device, and operations, such as uncovering, placing an animal cage, grabbing an animal and the like, are required at a top. Meanwhile, a tester needs a relatively large motion range. In order to facilitate relevant test operations, the isolation device needs to be provided with various forms of operation interfaces, and during the test, items need to be delivered. Therefore, the existing isolation device is difficult to meet the requirements of biosafety protection and isolation operations of the bio-aerosol exposure infection equipment, and since the influence of the sizes of an inlet channel and an outlet channel of an operating environment where the isolation device is located, the large size of the isolation device cannot achieve a non-specificity of site selection.

Therefore, developing and designing an isolation device for effectively reducing the bio-aerosol leakage risk of medium-sized and large-sized instruments and equipment, such as animal bio-aerosol exposure infection equipment and the like, has become a technical problem to be solved urgently at this stage.

SUMMARY

The present disclosure provides an isolation device for insolating aerosol exposure, including:

a cabin body; protective half suit arranged in the cabin body; a working table arranged at a horizontal position which the protective half suit in the cabin body can touch; and an air inlet device and an air exhaust device, arranged on a side wall of the cabin body.

Preferably, the cabin body is a flexible cabin body.

Preferably, the isolation device for insolating aerosol exposure further includes a rigid frame formed by a plurality of rods which are fixedly connected to one another by lap joints; and the cabin body is provided with connecting wrapping edges at corresponding positions which are configured for connecting with the rigid frame.

Preferably, the protective half suit has a structure of at least two layers.

Preferably, the protective half suit is further provided with an air supply filter device; the air supply filter device includes a fan, a filter box body and a HEPA filter, and is configured for providing clean air for the protective half suit; and the HEPA filter is mounted in the filter box body, and is configured for efficiently filtering environment air to be delivered into the protective half suit.

Preferably, the air supply filter device is communicated with an interior of the protective half suit through an air pipe, and inflates the protective half suit by air with a positive pressure; and an inner layer of the protective half suit is provided with air outlets at the positions of a neck and a sleeve and the like.

Preferably, a hollow is provided in the middle of the working table which is available for an operator to move.

Preferably, a bottom side of the protective half suit is hermetically connected with a flange protruding from a lower part of the hollow of the working table; and the cabin body of the isolation device for insolating aerosol exposure is hermetically connected with the flange.

Preferably, an isolation operating gloves are also arranged on the isolation device at a lower part of the protective half suit; and the isolation operating gloves are hermetically connected with the cabin body of the isolation device and is configured for operating a bio-aerosol exposure infection equipment at a bottom of the isolation device for insolating aerosol exposure.

Preferably, a sealing door is also arranged on one side, far away from an exhaust filter device, of the cabin body of the isolation device; and is configured for entrance and exit of the bio-aerosol exposure infection equipment.

Preferably, a delivery device is also arranged at an upper part of the working table 3 of the cabin body 1, and is configured for delivering small items; the delivery device is in hermetically connected with the cabin body, and an outside of the delivery device is hermetically connected with a closed bag; the delivered items may be placed in the closed bag, and the closed bag is removed from the delivery device after being sealed by a tie, so that delivery of the items inside the isolation device to the outside of the isolation device in a process of an experiment is achieved; or the items outside the isolation device may also be placed in the closed bag, the closed bag may be subjected to tying sealing inside the isolation device or may be subjected to heat sealing outside the isolation device, and the items are cut off inside the isolation device and are taken out from the closed bag to complete a process of delivering the items from the outside to the inside of the isolation device.

Preferably, the air inlet device arranged on the side wall of the cabin body is an air inlet high-efficiency filter device which is hermetically connected with the cabin body. The air inlet high-efficiency filter device is provided with an air inlet; the air inlet is provided with a quick interface which may be quickly connectable to a disinfection pipeline; and a HEPA filter is mounted inside the air inlet high-efficiency filter device.

Preferably, the air exhaust device arranged on the side wall of the cabin body is a high-efficiency exhaust filter device, and includes a first-stage exhaust high-efficiency filter device and a second-stage exhaust high-efficiency filter device.

Preferably, the first-stage exhaust high-efficiency filter device is provided with an air inlet which is hermetically connected with the cabin body; a high-efficiency air filter is mounted inside the first-stage exhaust high-efficiency filter device; an air exhaust opening is provided at a downstream of the first-stage exhaust high-efficiency filter device; the air exhaust opening is hermetically connected with the second-stage exhaust high-efficiency filter device through a pipeline; aerosol interfaces are respectively arranged at the positions close to two ends of the connecting pipeline and include a front end interface and a rear end interface; the front end interface is configured for an aerosol injection at a upstream of the second-stage exhaust high-efficiency filter device; and the rear end interface is configured for an aerosol sampling at the downstream of the first-stage exhaust high-efficiency filter device and an aerosol sampling at the upstream of the second-stage exhaust high-efficiency filter device.

Preferably, an exhaust high-efficiency filter is arranged inside the second-stage exhaust high-efficiency filter device; a downstream aerosol sampling opening and an exhaust fan are arranged at a downstream of the second-stage exhaust high-efficiency filter device; after the exhaust fan is started, there is a negative pressure inside the isolation device for insolating aerosol exposure; and under the action of the negative pressure, the air outside the isolation device enters the isolation device through the air inlet device 4, and a balance is gradually reached.

Preferably, quick flanges are respectively arranged at both the air inlet of the air inlet device 4 and the air exhaust outlet of the air exhaust device; when a space inside the isolation device, the air inlet device and the air exhaust device are disinfected, a disinfection machine may be connected to the air inlet and the air exhaust outlet through pipelines respectively to form a closed loop, and air circulation disinfection is performed through the exhaust fan.

Preferably, a control panel is also arranged on one side of the isolation device; a controller is arranged to connect with the control panel; and the control panel is provided with start/stop buttons and speed regulation devices of the air supply filter device and the exhaust fan of the protective half suit.

Preferably, the hollow in the middle of the working table is a circular hollow.

Preferably, lighting equipment is also arranged at a top end of the isolation device and is connected to the control panel, which facilitates lighting control during an operation.

Compared with the prior art, the present disclosure provides the isolation device for insolating aerosol exposure, which has the following beneficial effects:

1. according to the present disclosure, by using the support structure of the cabin body and the rigid frame, the isolation device is flexibly assembled and disassembled and is easy to carry, may be arranged in operating environments that require space with a plurality of sizes, and may be conveniently mounted in an existing laboratory; and
2. the present disclosure realizes physical isolation of high-risk operations based on design mechanisms of negative pressure control, airtight isolation, and high-level personnel protection, which can effectively protect the operator and prevent the environment from being polluted.

Figure 1:
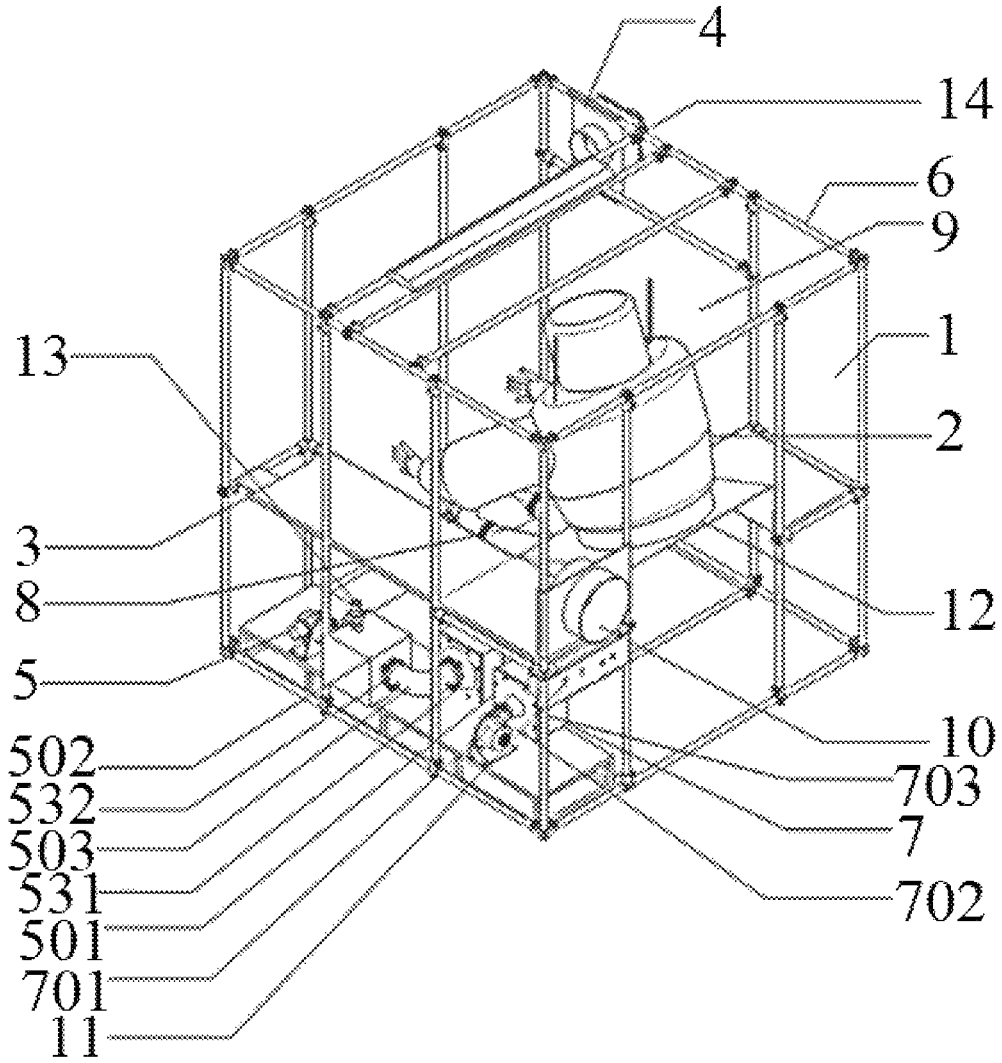
FIG. 1 is a schematic structural diagram of an isolation device for insolating aerosol exposure according to an embodiment of the present disclosure.

In the drawings: 1, a cabin body; 2, a protective half suit: 3, a working table; 4, an air inlet device; 401, an air inlet; 402, a quick interface (flange); 403, a HEPA filter; 5, an air exhaust device: 501, a first-stage exhaust high-efficiency filter device: 511, an air inlet: 512, a high-efficiency air filter: 513, an air exhaust opening: 502, a second-stage exhaust high-efficiency filter device: 521, an exhaust high-efficiency filter: 522, a downstream aerosol sampling opening: 523, an exhaust fan; 503, an aerosol interface; 531, a front end interface; 532, a rear end interface; 6, a rigid frame: 7, an air supply filter device; 701, an air supply fan; 702, an air supply filter box body, an air supply high-efficiency filter: 8, an isolation operating glove: 9, a sealing door; 10, a delivery device: 11, a control panel: 12, a protective clothing mounting base; 13, a disinfection interface; and 14, a lighting equipment.

DETAILED DESCRIPTION OF THE EMBODIMENTS

Exemplary embodiments of this application will be described in more detail below with reference to accompanying drawings. Although the exemplary embodiments of this application are shown in the accompanying drawings, it should be understood that this application may be implemented in various forms and should not be limited by the embodiments set forth herein. On the contrary, these embodiments are provided to enable a more thorough understanding of this application and completely convey the scope of this application to a person skilled in the art.

Referring to FIG. 1, the present disclosure provides an isolation device for insolating aerosol exposure, including a cabin body 1; a protective half suit 2 arranged in the cabin body 1, where the protective half suit 2 may effectively protect an operator, and avoid the harm to human bodies caused by harmful gas during operating; a working table 3 arranged at a horizontal position which the protective half suit 2 in the cabin body 1 can touch, where the working table may be configured for placing items during operating, which facilitates a test operation of the operator in a motion range; an air inlet device 4; and an air exhaust device 5, where the air inlet device 4 and the air exhaust device 5 are arranged on a side wall of the cabin body 1 to ensure an air pressure control in the cabin body, realize a safe operation and effectively protect the operator and an environment from being damaged by harmful substances.

The cabin body 1 is a flexible cabin body, and is made of a flexible material. The flexible material is a material that can be extruded and deformed, and includes, but is not limited to, fiber fabric such as glass cloth supplemented with foamed polyurethane or polyvinyl butyral and the like, which has toughness, elasticity, and good safety, may adapt to changes in pressure between operations during an exposure infection operation, and may also ensure to provide a safe isolation environment during an operation. Preferably, the flexible material includes a thermal insulation protective layer and an anti-scraping layer from outside to inside. Preferably, the flexible material includes a thermal insulation protective layer, a dimensional strengthening layer, and an anti-scraping layer from outside to inside. The thermal insulation protective layer includes, but is not limited to, nylon, a polyester film and similar functional materials, and is configured for ensuring that an operating environment temperature and an external environment temperature cannot affect an internal operating temperature of the isolation device. The dimensional strengthening layer includes, but is not limited to, poly-p-phenylene terephthalamide, a phenylene material, and materials with same function. Such materials have low density, high strength, good toughness, and high temperature resistance, are easy to processing and molding, and are configured for ensuring that the isolation device has certain shape and strength and guaranteeing an isolation effect of the operating space and an isolation effect inside and outside the device. The anti-scraping layer includes, but is not limited to, p-benzoyl-p-phenylenediamine and meta-polyarylamide products, this material has high size stability, strong mechanical performance, and good flexibility, which brings good airtightness, meanwhile, can effectively prevent damage to the flexible cabin body of the isolation device during an isolation operation, thereby further avoiding the occurrence of exposure events and damage to personnel and an environment and improving the operation safety. By using the protective material, the operating environment can be prevented from being affected by an external temperature: the isolation operating environment is stable; the pressure changes inside and outside the device cannot affect a normal operation: the airtightness is good; the damage to the flexible cabin body caused by the isolation operation can be avoided; and the personnel and the environment safety of the isolation operation is improved.

The isolation device for insolating aerosol exposure further includes a rigid frame 6, the rigid frame 6 is formed by a plurality of rods which are fixedly connected to one another by lap joints; and the cabin body 1 is provided with connecting wrapping edges at corresponding positions which are configured for connecting with the rigid frame 6. The connecting wrapping edge is made of the material used by the flexible cabin body. At least two pairs of edges are arranged at opposite angles of an upper bottom surface of the rigid frame 6 of the cabin body to ensure the stability of a space of the cabin body. In combination with the flexible cabin body, a support structure of the flexible cabin body and the rigid frame can be flexibly disassembled, are easy to transport, may be arranged in operating environments that require space with a plurality of sizes, and can be conveniently mounted in the existing laboratory.

The protective half suit 2 is at least of a structure of at least two layers. The structure may be made of the same material as the material of the flexible cabin body, or may be made of other flexible materials with same function, which ensures the operation integrity and safety of the cabin body, and meanwhile, facilitates flexible operation of the personnel in the isolation device.

The protective half suit 2 is further provided with an air supply filter device 7. The air supply filter device 7 includes a fan 701, a filter box body 702, and a HEPA filter 703, and is configured for providing clean air for the protective half suit 2. The HEPA filter 703 is mounted in the filter box body 702, and is configured for efficiently filtering environment air to be delivered into the protective half suit 2. The air supply filter device 7 is communicated with an interior of the protective half suit 2 through an air pipe, inflates the protective half suit 2 by air with a positive pressure. An inner layer of the protective half suit 2 is provided with air outlets at the positions of a neck and a sleeve and the like, which can meet the requirements of operator breathing, ventilation, and protection.

Figure 2:
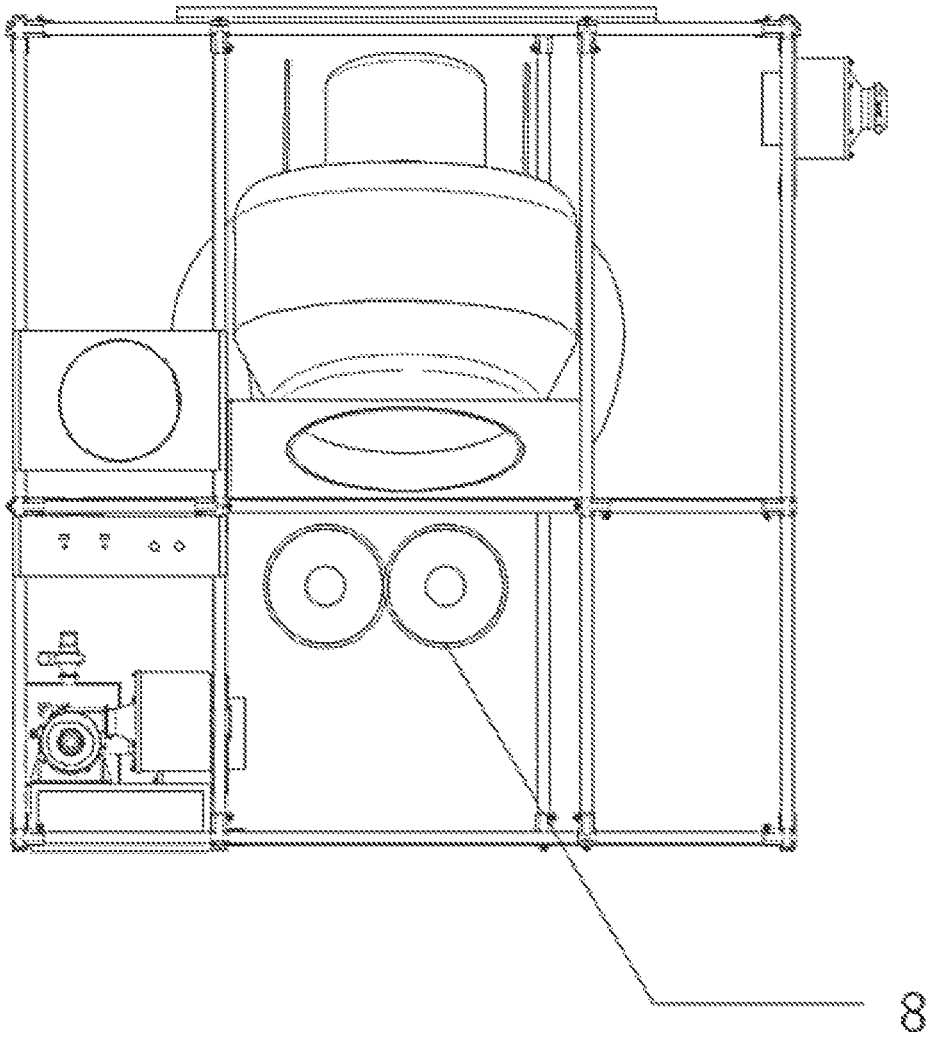
FIG. 2 is a schematic diagram of isolation operating gloves of the isolation device for insolating aerosol exposure according to an embodiment of the present disclosure.

Referring to FIG. 2, a hollow is provided in the middle of the working table 3, and the operator can perform a test operation in the isolation device at this position, which meets the motion requirement of the operator. A bottom side of the protective half suit 2 is hermetically connected with a flange protruding from a lower part of the hollow of the working table 3. The cabin body 1 of the isolation device for insolating aerosol exposure is hermetically connected with the flange. Preferably, a protective clothing mounting base 12 is arranged at a connection between the isolation device for insolating aerosol exposure and the flange. Preferably, the hollow in the middle of the working table 3 is a circular hollow. A bottom side of the protective half suit 2 is hermetically connected with the working table 3, which can effectively ensure the isolation inside and outside of the operating environment, and realizes the safety of an operation, thereby ensuring the safety of the personnel and the environment. Insolation operation gloves 8 are also arranged on the isolation device at a lower part of the protective half suit 2; and the isolation operating gloves 8 are connected with the cabin body 1 of the isolation device, and are configured for operating bio-aerosol exposure infection equipment at a bottom of the isolation device for insolating aerosol exposure. The protective half suit 2 is used as personnel isolation operation equipment, and the isolation operating gloves 8 mounted at the bottom are used as auxiliary operation equipment, which can effectively improve the motion range of the isolation operation of the personnel, and solves a problem of the isolation operation of aerosol exposure infection equipment.

Figure 3:
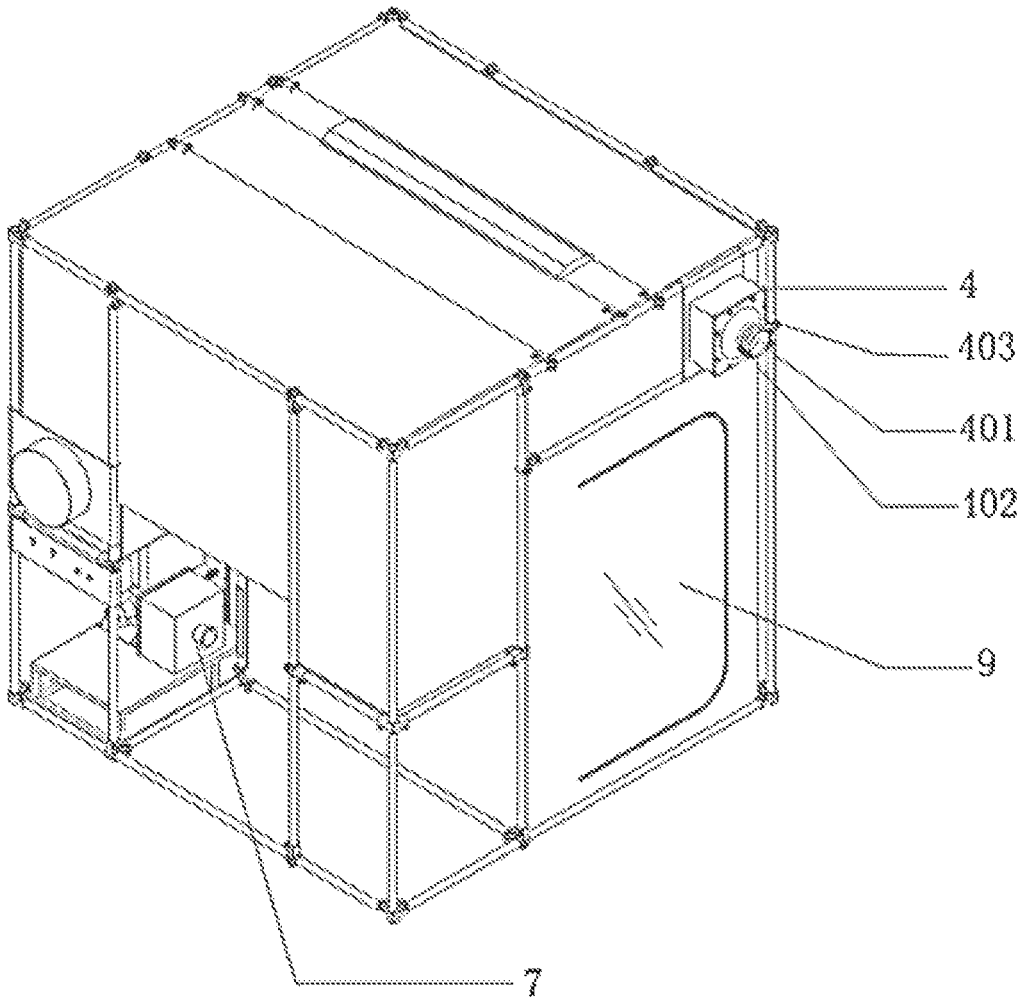
FIG. 3 is a schematic diagram of an air inlet device of an isolation device for insolating aerosol exposure according to an embodiment of the present disclosure.

Referring to FIG. 3, a sealing door 9 is also arranged on one side, far away from an exhaust filter device, of the cabin body 1 of the isolation device. The sealing door 9 is configured for entrance and exit of the bio-aerosol exposure infection equipment.

A delivery device 10 is also arranged at an upper part of the working table 3 of the cabin body 1, and is configured for delivering small items. The delivery device 10 is hermetically connected with the cabin body 1, and an outside of the delivery device 10 is hermetically connected with a closed bag. The delivered items may be placed in the closed bag, and the closed bag is removed from the delivery device (10) after being sealed by a tie, so that delivery of the items inside the isolation device to the outside of the isolation device in a process of an experiment is achieved.

The air inlet device 4 arranged on the side wall of the cabin body 1 is an air inlet high-efficiency filter device which is connected with the cabin body 1. The air inlet high-efficiency filter device is provided with an air inlet 401. The air inlet 401 is provided with a quick interface 402. The quick interface 402 may be quickly connectable to a disinfection pipeline, and a HEPA filter 403 is mounted inside the air inlet high-efficiency filter device. The high-efficiency filter 403 selects a HEPA filter that complies with biosafety laboratory specifications. Preferably, a High Efficiency Particulate Air Filter/an Ultra-Low Penetration Air Filter (HEPA/ULPA) or similar filters consisting of a hard housing support and a filter membrane with an extended and folded medium may be selected, which ensures that air in the isolation device reaches specified cleanliness by filtering particles such as dust outside the isolation device; and possible pollution particles outside the device are filtered, a sample is protected, and cross contamination between samples and during the operation are avoided.

Figure 4:
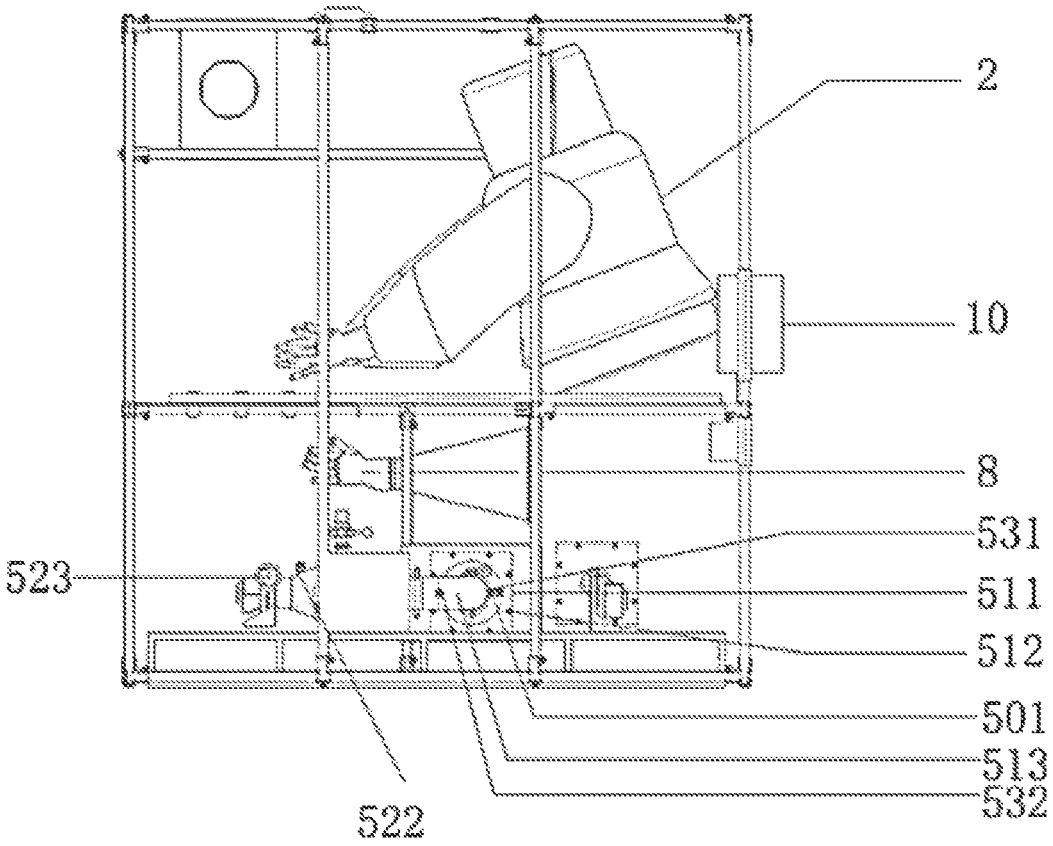
FIG. 4 is a schematic diagram of an air exhaust device of an isolation device for insolating aerosol exposure according to an embodiment of the present disclosure.

Referring to FIG. 4, the air exhaust device 5 is arranged on the side wall of the cabin body 1. The air exhaust device 5 is a high-efficiency exhaust filter device, and includes a first-stage exhaust high-efficiency filter device 501 and a second-stage exhaust high-efficiency filter device 502. Preferably, the first-stage exhaust high-efficiency filter device 501 is provided with an air inlet 511 which is hermetically connected with the cabin body 1. A high-efficiency air filter 512 is mounted inside the first-stage exhaust high-efficiency filter device 501. An air exhaust opening 513 is provided at a downstream of the first-stage exhaust high-efficiency filter device 501. The air exhaust opening 513 is hermetically connected with the second-stage exhaust high-efficiency filter device 502 through a pipeline. Aerosol interfaces 503 are respectively arranged at the positions, close to two ends of the connecting pipeline, and include a front end interface 531 and a rear end interface 532. The front end interface 531 is configured for an aerosol injection at a upstream of the second-stage exhaust high-efficiency filter device 502. The rear end interface 532 is configured for an aerosol sampling at the downstream of the first-stage exhaust high-efficiency filter device 501 and an aerosol sampling at the upstream of the second-stage exhaust high-efficiency filter device 502. An exhaust high-efficiency filter 521 is arranged inside the second-stage exhaust high-efficiency filter device 502. A downstream aerosol sampling opening 522 and an exhaust fan 523 are arranged at a downstream of the second-stage exhaust high-efficiency filter device 502. Both the first-stage exhaust high-efficiency filter device 501 and the second-stage exhaust high-efficiency filter device 502 are internally provided with high-efficiency filters that comply with biosafety laboratory specifications. Preferably, a High Efficiency Particulate Air Filter/an Ultra-Low Penetration Air Filter (HEPA/ULPA), or similar filters consisting of a hard housing support and a filter membrane with an extended and folded medium may be selected, which ensures that the air in the isolation device reaches specified cleanliness by filtering particles such as dust outside the isolation device; and by filtering away dangerous particles such as aerosols that may be generated during a test, the sample is protected, and the cross contamination between the samples and during the operation are avoided. The dangerous particles are further prevented from being directly exhausted into the environment during exhausting the air from the isolation device, and the safety of the personnel and the environment is guaranteed.

After the exhaust fan 523 is started, there is a negative pressure inside the isolation device for insolating aerosol exposure. Under an action of the negative pressure, an air outside the isolation device enters the isolation device through the air inlet device 4, and a balance is gradually reached. Based on principles of negative pressure control, airtight isolation and high-level personnel protection, physical isolation of high-risk operations is realized, and the problems of protecting the operator and preventing environmental pollution are effectively solved.

Quick flanges are respectively arranged at both the air inlet 401 of the air inlet device 4 and the air exhaust outlet of the air exhaust device 5. When a space inside the isolation device, the air inlet device 4 and the air exhaust device 5 are disinfected, a disinfection machine may be connected to the air inlet 511 and the air exhaust outlet through pipelines respectively to form a closed loop, and air circulation disinfection is performed through the exhaust fan. Air circulation disinfection is performed through the exhaust fan, safe control of the operating environment and the sample is ensured, and possible cross contamination is avoided.

A control panel 11 is also arranged on one side of the isolation device; a controller is arranged to connect with the control panel 11; the control panel 11 is provided with start/stop buttons and speed regulation devices of the air supply filter device 7 and the exhaust fan 523 of the protective half suit 2, which can realize pressure control in the cabin body and operating environment control during the operation. During circulation disinfection, the control panel may also be configured for air flow and pressure control. The control panel 11 is arranged at an accessible position of the protective half suit 2, which may also facilitate effective control of the operator on air inlet, air exhaust, and pressure in the cabin body during the operation.

The hollow in the middle of the working table 3 inside the isolation device is a circular hollow, which facilitates motion of the operator in a relatively large motion range, and also facilitates sealed connection between the protective half suit 2 and the flange protruding from the lower part of the hollow of the working table 3 through the protective clothing mounting base 12. A sealing structure of the isolation device is formed through further sealed connection of the cabin body 1 and the flange. Sealed connection of the flange is facilitated by using a circular hollow, a multi-angle operation of the operator is also facilitated, a sealing effect is improved, and meanwhile, an operation is more flexible.

A lighting equipment 14 is also arranged at a top end of the isolation device. The lighting equipment 14 is connected to the control panel 11, so as to turn on the lighting equipment as the test required.

The present disclosure is ingenious in structural design, the support structure of the flexible cabin body and the rigid frame is used, which realizes flexible assembling and disassembling and easiness in transportation and may be mounted in an existing laboratory conveniently. The protective half suit is used as personnel isolation operation equipment, and the isolation operation gloves mounted at a bottom are used as auxiliary operation equipment, which can effectively improve the motion range of the isolation operation of the personnel, and solve a problem of the isolation operation of the aerosol exposure infection equipment. Based on principles of negative pressure control, airtight isolation, and high-level personnel protection, physical isolation of high-risk operations is realized, and problems of protecting the operator and preventing the environmental pollution are effectively solved.

It should be noted that the term "include", or any variants thereof is intended to cover a non-exclusive inclusion, so that a process, a method, an item, or equipment including a series of elements not only includes these elements but also includes elements that are not expressly listed, or further includes elements inherent to such process, method, item, or equipment. In the absence of more restrictions, elements defined by the phrase "include . . . " do not exclude the existence of additional identical elements in the process, method, item, or equipment that includes the elements.

The above is merely the embodiments of this application, and is not intended to limit this application. For those skilled in the art, this application may have various changes and variations. Any modifications, equivalent substitutions, improvements, etc. that come within the spirit and principles of the present application are intended to be included within the scope of the claims of the present application.

What is claimed is:

1. An isolation device for insolating aerosol exposure, comprising:

a cabin body (1);

a protective half suit (2) arranged in the cabin body (1);

a working table (3) arranged in an accessible horizontal position of the protective half suit (2) in the cabin body (1); and an air inlet device (4) and an air exhaust device (5) arranged on a side wall of the cabin body (1);

wherein a hollow is provided in a middle of the working table (3) which is available for an operator to move; and a bottom side of the protective half suit (2) is hermetically connected with a flange protruding from a lower part of the hollow of the working table (3); and the cabin body (1) of the isolation device for insolating aerosol exposure is hermetically connected with the flange.

2. The isolation device for insolating aerosol exposure according to claim 1, wherein the cabin body (1) is a flexible cabin body;

the isolation device further comprises a rigid frame (6) formed by a plurality of rods which are fixedly connected to one another by lap joints; and the cabin body (1) is provided with connecting wrapping edges at corresponding positions which are configured for connecting with the rigid frame (6).

3. The isolation device for insolating aerosol exposure according to claim 2, wherein the protective half suit (2) has a structure of at least two layers;

the protective half suit (2) is further provided with an air supply filter device (7); and the air supply filter device (7) comprises a fan (701), a filter box body (702) and a HEPA filter (703), and is configured for providing clean air for the protective half suit (2);

the HEPA filter (703) is mounted in the filter box body (702), and is configured for efficiently filtering environment air to be delivered into the protective half suit (2);

the air supply filter device (7) is communicated with an interior of the protective half suit (2) through an air pipe, and inflates the protective half suit (2) by air with a positive pressure; and an inner layer of the protective half suit (2) is provided with air outlets at positions of a neck and a sleeve.

4. The isolation device for insolating aerosol exposure according to claim 2, wherein a hollow is provided in a middle of the working table (3) which is available for an operator to move; and a bottom side of the protective half suit (2) is hermetically connected with a flange protruding from a lower part of the hollow of the working table (3); and the cabin body (1) of the isolation device for insolating aerosol exposure is hermetically connected with the flange.

5. The isolation device for insolating aerosol exposure according to claim 2, wherein a sealing door (9) is arranged on one side, far away from the air exhaust device (5), of the cabin body (1) of the isolation device, and is configured for entrance and exit of a bio-aerosol exposure infection equipment; and a delivery device (10) is arranged at an upper part of the working table (3) of the cabin body (1) and is configured for delivering small items; the delivery device (10) is hermetically connected with the cabin body (1), an outside of the delivery device (10) is hermetically connected with a closed bag, the delivered items are placed in the closed bag, and the closed bag is removed from the delivery device (10) after being sealed by a tie, so that delivery of the items inside the isolation device to the outside of the isolation device in a process of an experiment is achieved.

6. The isolation device for insolating aerosol exposure according to claim 1, wherein the protective half suit (2) has a structure of at least two layers;

the protective half suit (2) is further provided with an air supply filter device (7); and the air supply filter device (7) comprises a fan (701), a filter box body (702) and a HEPA filter (703), and is configured for providing clean air for the protective half suit (2);

the HEPA filter (703) is mounted in the filter box body (702), and is configured for efficiently filtering environment air to be delivered into the protective half suit (2);

the air supply filter device (7) is communicated with an interior of the protective half suit (2) through an air pipe, and inflates the protective half suit (2) by air with a positive pressure; and an inner layer of the protective half suit (2) is provided with air outlets at positions of a neck and a sleeve.

7. The isolation device for insolating aerosol exposure according to claim 6, wherein the air inlet device (4) arranged on the side wall of the cabin body (1) is an air inlet high-efficiency filter device which is hermetically connected with the cabin body (1); the air inlet high-efficiency filter device is provided with an air inlet (401); the air inlet (401) is provided with a quick interface (402) which is quickly connectable to a disinfection pipeline; and a HEPA filter (403) is mounted inside the air inlet high-efficiency filter device.

8. The isolation device for insolating aerosol exposure according to claim 7, wherein the air exhaust device (5) arranged on the side wall of the cabin body (1) is a high-efficiency exhaust filter device, and comprises a first-stage exhaust high-efficiency filter device (501) and a second-stage exhaust high-efficiency filter device (502);

the first-stage exhaust high-efficiency filter device (501) is provided with an air inlet (511) which is hermetically connected with the cabin body (1); a high-efficiency air filter (512) is mounted inside the first-stage exhaust high-efficiency filter device (501); an air exhaust opening (513) is provided at a downstream of the first-stage exhaust high-efficiency filter device (501); the air exhaust opening (513) is hermetically connected with the second-stage exhaust high-efficiency filter device (502) through a pipeline; aerosol interfaces (503) are respectively arranged at the positions close to two ends of the pipeline and comprise a front end interface (531) and a rear end interface (532); the front end interface (531) is configured for an aerosol injection at a upstream of the second-stage exhaust high-efficiency filter device (502); and the rear end interface (532) is configured for an aerosol sampling at the downstream of the first-stage exhaust high-efficiency filter device (501) and an aerosol sampling at the upstream of the second-stage exhaust high-efficiency filter device (502); and an exhaust high-efficiency filter (521) is arranged inside the second-stage exhaust high-efficiency filter device (502); a downstream aerosol sampling opening (522) and an exhaust fan (523) are arranged at a downstream of the second-stage exhaust high-efficiency filter device (502); after the exhaust fan (523) is started, there is a negative pressure inside the isolation device for insolating aerosol exposure; and under an action of the negative pressure, an air outside the isolation device enters the isolation device through the air inlet device (4), and a balance is gradually reached.

9. The isolation device for insolating aerosol exposure according to claim 8, wherein quick flanges are respectively arranged at both the air inlet (401) of the air inlet device (4) and the air exhaust outlet of the air exhaust device (5); when a space inside the isolation device, the air inlet device (4) and the air exhaust device (5) are disinfected, a disinfection machine is connected to the air inlet (401) and the air exhaust outlet through pipelines respectively to form a closed loop, and air circulation disinfection is performed through the exhaust fan.

10. The isolation device for insolating aerosol exposure according to claim 9, wherein a control panel (11) is arranged on one side of the isolation device; a controller is arranged to connect with the control panel (11); the control panel (11) is provided with start/stop buttons and speed regulation devices of the air supply filter device (7) and the exhaust fan (523) of the protective half suit (2);

a hollow in a middle of the working table (3) is a circular hollow; and a lighting equipment (14) is arranged at a top end of the isolation device and is connected to the control panel (11).

11. The isolation device for insolating aerosol exposure according to claim 1, wherein isolation operating gloves (8) are arranged on the isolation device at a lower part of the protective half suit (2); and the isolation operating gloves (8) are hermetically connected with the cabin body (1) of the isolation device and are configured for operating a bio-aerosol exposure infection equipment at a bottom of the isolation device for insolating aerosol exposure.

12. The isolation device for insolating aerosol exposure according to claim 11, wherein a sealing door (9) is arranged on one side, far away from the air exhaust device (5), of the cabin body (1) of the isolation device, and is configured for entrance and exit of the bio-aerosol exposure infection equipment; and a delivery device (10) is arranged at an upper part of the working table (3) of the cabin body (1) and is configured for delivering small items; the delivery device (10) is hermetically connected with the cabin body (1), an outside of the delivery device (10) is hermetically connected with a closed bag, the delivered items are placed in the closed bag, and the closed bag is removed from the delivery device (10) after being sealed by a tie, so that delivery of the items inside the isolation device to the outside of the isolation device in a process of an experiment is achieved.

* * * * *